United States Patent [19]

Dupré

[11] Patent Number: 4,488,845

[45] Date of Patent: Dec. 18, 1984

[54] PAPER PADDING OR TABLETING PRESS

[76] Inventor: Gilbert J. Dupré, 221 Florida St., Baton Rouge, La. 70801

[21] Appl. No.: 401,067

[22] Filed: Jul. 23, 1982

[51] Int. Cl.[3] ..... B42B 5/00; B42C 3/00; B42C 9/00

[52] U.S. Cl. ..... 412/10; 100/219; 412/1

[58] Field of Search ..... 100/219; 412/10, 1, 412/9

[56] References Cited

U.S. PATENT DOCUMENTS

| | | | |
|---|---|---|---|
| 1,024,721 | 4/1912 | Davis | 472/10 |
| 1,928,789 | 10/1933 | Legge | 412/10 |
| 2,169,341 | 8/1939 | Goines et al. | 412/10 |
| 2,494,424 | 1/1950 | Adelsohn et al. | 412/10 |
| 2,641,781 | 6/1953 | Haskell | 412/10 |
| 2,654,932 | 10/1953 | Goudie | 24/243 R |
| 3,986,447 | 10/1976 | Zimmer | 412/10 X |
| 4,146,942 | 4/1979 | Westra et al. | 100/219 X |

*Primary Examiner*—Paul A. Bell
*Attorney, Agent, or Firm*—David L. Ray

[57] ABSTRACT

A padding press is disclosed for firmly holding sheets of paper to which adhesive, gummed cloth, or other material is to be attached at one edge to make the sheets into pads or books.

10 Claims, 12 Drawing Figures

PAPER PADDING OR TABLETING PRESS

BACKGROUND OF THE INVENTION

This invention relates to a machine for firmly holding paper, and, in particular, sheets of paper to which adhesive, gummed cloth or other material is to be attached at one edge to make the material into pads or books.

In the past sheets of paper have been held in permanent position by placing heavy weights on the top of sheets of paper which is still sometimes done today. However, most of such gluing and padding operations are today accomplished with a padding press. However in using some equipment commonly available in the padding press field, the paper to be padded is jogged or shaken on the padding edge and then the paper is turned so that the padding edge faces away from the operator. The paper is then stacked against the backboard of the press. The entire press including the pads or tablet must then be lifted from the base, turned 180 degrees so that the padding edge faces the operator before the padding adhesive can be applied. Such devices make it difficult to stack the sheets straight in the press and difficult to keep the sheets aligned on the padding edge while they are turned 180 degrees. Another disadvantage of such existing padding presses is that in some cases the operator must tighten a thumb screw or a similar device at the left and right edge of the pads or tablets, turning first one and then the other back and forth until the desired pressure is achieved.

Some of the padding presses of the prior art provide for swiveling the stack of sheets on the base to bring the padding edge in alignment with the operator after stacking. Other presses are on casters and the entire press must be rolled around 180 degrees, or the operator may walk around to the back side to apply the padding adhesive to the padding edge. One of the disadvantages of the equipment of the prior art is that a large amount of time is required to stack the sheets into the press. Also it is difficult to stack the sheets straight. A considerable amount of physical exertion on the part of the operator is required to apply the necessary pressure to the pad and a large clamping area is required even when only a short stack of sheets is to be padded. Exemplary of the padding presses of the prior art are U.S. Pat. Nos. 4,146,942; 3,986,447; 2,654,932; 2,641,781; 2,494,424; 2,169,341; 1,928,789; and 1,024,721.

SUMMARY OF THE INVENTION

In accordance with the present invention there is provided a padding press which is compact, inexpensive and easy to operate. The various components of the padding press can be disassembled and stored in a very small space. The padding press may be placed upon a table or other flat surface when it is being used. In one embodiment of the padding press of the invention most of the components of the padding press are contained in a drawer which slides into the base of the padding press. An alternative design provides for a caddy at the rear of the press for holding the modular components.

Another advantage of the invention is that the invention is of modular construction so that no more of the press is used than is required for given stack of sheets or tablets. Another advantage of the invention is that a padding press is provided in to which the sheets are stacked in same position in which they are jogged, i.e. with a padding edge facing the operator or the front of the press. The padding press of the present invention has paper stops against which the sheets are stacked to insure a straight stack of pads. Another advantage of the press of the invention is that the sheets to be padded are instantly locked under pressure with minimum operator effort. A further advantage of the invention is that the padding adhesive can be applied without the necessity of lifting the stack of papers or swiveling the stack around 180 degrees prior to applying the adhesive. The drawer or the alternative protruding paper stop support also functions as a brace to prevent the press from being turned over when the press is tilted for loading, and the drawer or protruding support may have a removable trough or shield to catch adhesive drippings when the adhesive is brushed on the padding edge of the tablets or books. In another embodiment of the invention, the upper and lower pressure surfaces which strike the paper or tablet preferably contain a surface or coating from which padding adhesive can be easily stripped, leaving a clean new surface and thereby insuring precision padding of high quality.

The padding press of the invention includes a stationary base, a paper supporter connected thereto which may be tilted from the horizontal to aid in aligning the tablet or papers, a pair of dowels connectable to the paper supporter, a paper pressing mechanism connectable to the dowels, the pressing mechanism having locking means for locking the paper pressing mechanism in position on the dowels after the press is lowered onto the surface of the paper to be padded, and lever arms for exerting additional pressure upon the stacks of paper to be padded.

BRIEF DESCRIPTION OF THE DRAWINGS

The invention will be more readily understood by reference to the following drawings in which.

DESCRIPTION OF THE PREFERRED EMBODIMENT

Figure 1:
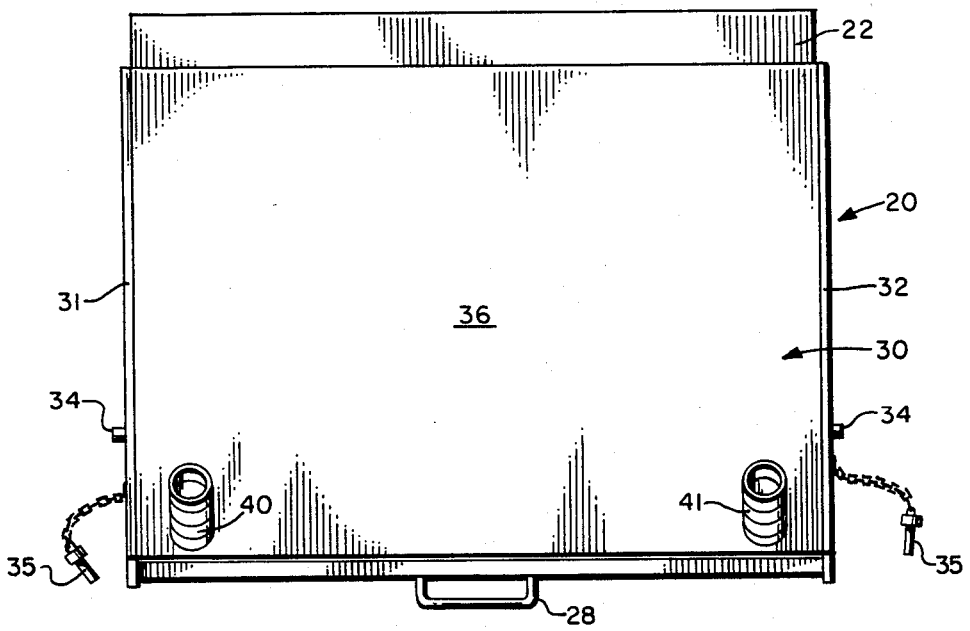
FIG. 1 is a top plan view of the padding press of the invention with the pressure mechanism removed.
Figure 2:
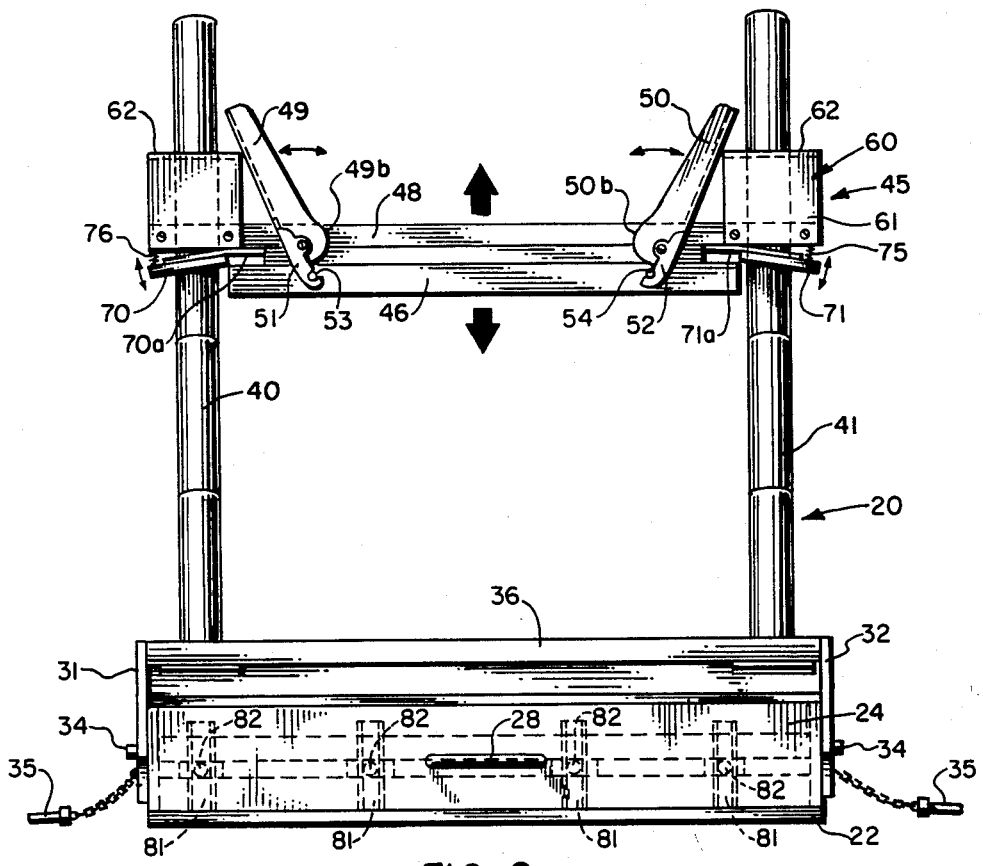
FIG. 2 is a front elevational view partly cut-away of the padding press of the invention having internal portions indicated by dotted lines.

Referring now to the drawings, in FIGS. 1 and 2 are shown the padding press of the invention generally indicated by the numeral 20. As can be seen in the drawings, the padding press includes a base generally indicated by the numeral 22, and preferably has a trough 24*a* for receiving any drops of glue that may drip from the paper being glued as shown in FIG. 11.

Figure 4:
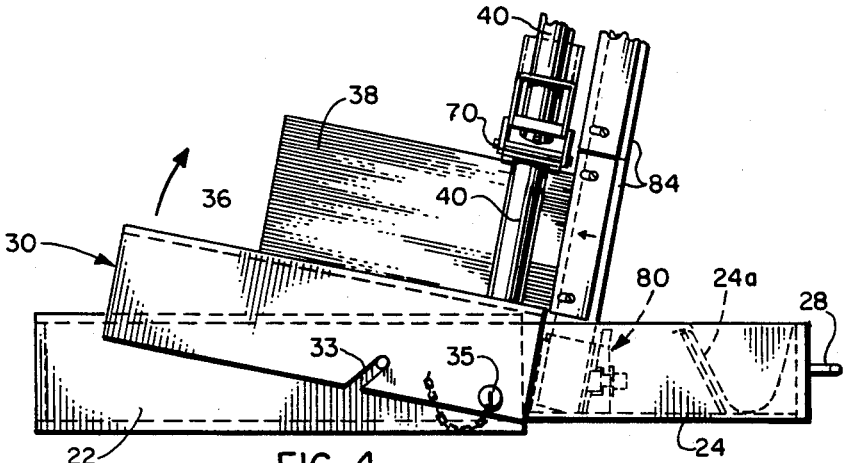
FIG. 4 is a partly cut-away view of the padding press of the invention with the paper stacking guide shown in place and the pressure mechanism being placed upon sheets of paper.
Figure 11:
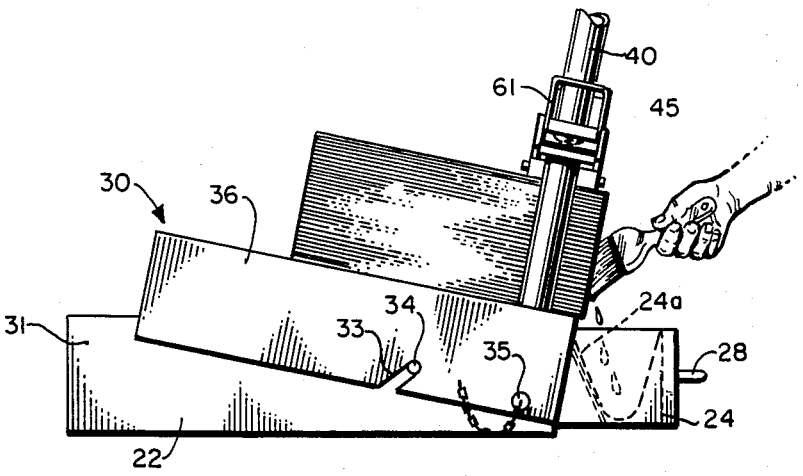
FIG. 11 is a side view of the invention showing glue being applied to the stack of paper.
Figure 12:
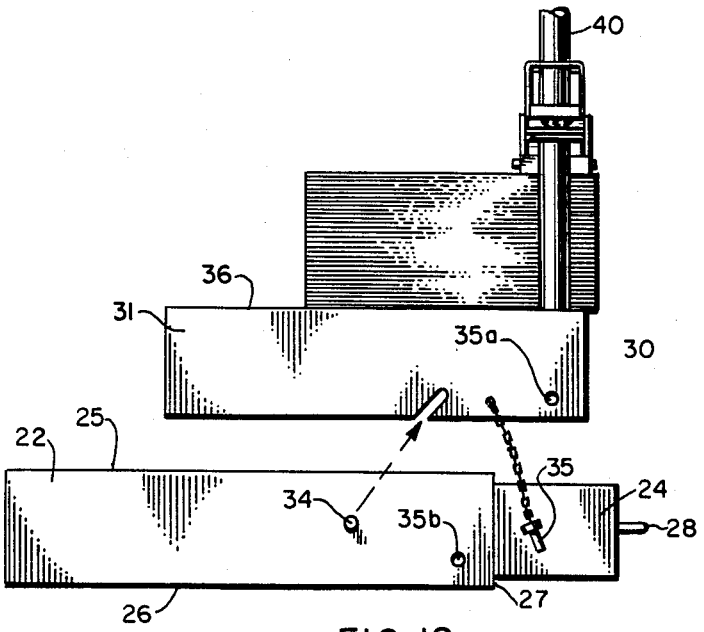
FIG. 12 is a side elevational view partly cut-away of the paper supporter being lifted from the base of the invention.

As can best be seen in FIGS. 4, 11 and 12, base 22 has sliding drawer 24 therein. Base 22 has a rectangular top 25 and a rectangular bottom 26. Base 22 may be placed on a table or other surface when the padding press is being operated. The sides and end of base 22 are also rectangular and the front end 27 is open for sliding receipt of drawer 24. Drawer 24 has a handle 28 thereon for grasping to slide the drawer out of base 22 and preferably contains trough 24*a*.

Located immediately above base 22 is a tilting paper supporter generally indicated by the numeral 30. Paper supporter 30 has a flat upper surface 36 upon which paper bundles such as those indicated by the numeral 38 in FIG. 4 rest. Paper supporter 30 has two rectangular sides 31 and 32.

Figure 3:
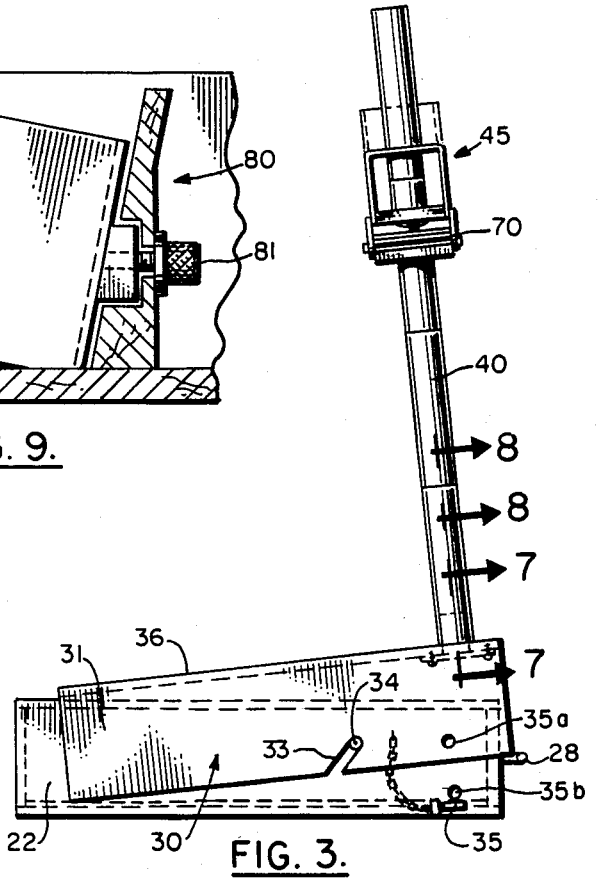
FIG. 3 is a side elevational view of the padding press of the invention having internal portions indicated by dotted lines.

Located on both of sides 31 and 32 are slots 33 for receipt of pins 34. Pin 34 serves as a pivot pin so that the table may be inclined from one position to the other, as for example is shown in FIG. 3 and FIG. 4. Locking pins 35 are connected by a chain 35*c* to the sides 31 and 32 of paper supporter 30. Pin 35 can be inserted into hole 35*a* to lock the paper supporter 30 in the position shown in FIG. 4. When pins 35 are removed from holes 35*a* and 35*b*, the paper supporter 30 can be tilted to the position shown in FIG. 3.

Figure 8:
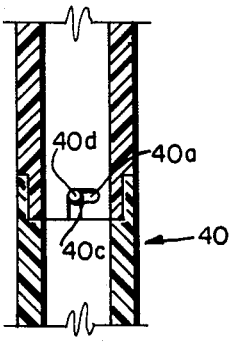
FIG. 8 is a detailed cross-sectional view of the modular dowels of the invention.
Figure 7:
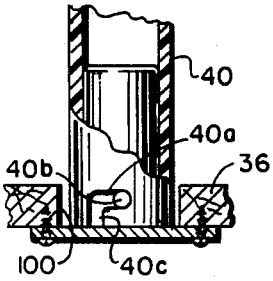
FIG. 7 is cross-sectional view taken along lines 7—7 of FIG. 3.

As can best be seen in FIG. 2, connected to the upper surface 36 of paper supporter 30 are two dowels 40 and 41. The dowels 40 and 41 can be attached by any means well known in the art such as gluing, bolting, screwing or the like, but the preferred method of attachment is illustrated in FIG. 7. As shown in FIG. 7, a cylindrical recess 100 is formed in the top 36 of paper supporter 30. Dowels 40 and 41 have an "L" shaped slot 40*a* therein for engagement with pin 40*b* contained in cylindrical recess 100. The dowels are rotated so that the bottom 40*c* of "L" shaped slot 40*a* is aligned with pin 40*b*. The dowel is then inserted downwardly into recess 100 and rotated clockwise to secure the dowel to paper supporter 30. If desired the dowels may be constructed as shown in FIG. 8 with a slot 40*a* in one end and a pin 40*d* in the other end which allow two sections of dowels to be joined together in the same manner as the dowels are connected to paper supporter 30.

Slidably connected to dowels 40 and 41 is the pressure plate assembly generally indicated by the numeral 45. The pressure plate assembly 45 applies a downward pressure to paper 38 stacked on paper supporter 30 to hold the paper securely in place while glue is applied as shown in FIG. 11.

Figure 10:
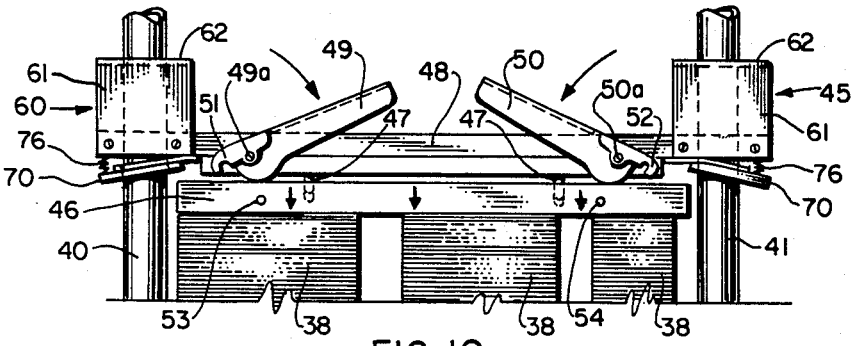
FIG. 10 is a detailed front view of a portion of the pressing mechanism of the invention placed upon a stack of paper.

The pressure plate assembly includes a pressure plate 46 which directly contacts paper 38 stacked on paper support 30. If desired the paper may be arranged in three stacks having different widths such as shown in FIG. 10. Pressure plate 46 is a flat plate having a series of pins 47 shown in FIG. 10 extending upwardly therefrom which are received in cylindrical holes contained in pressure plate support bar 48. Thus the pins allow relative movement between plate 46 and pressure plate support bar 48 while maintaining alignment.

Pressure plate support bar 48 has two lever arms 49 and 50 pivotally connected thereto about pins 49*a* and 50*a* which apply a downward force to pressure plate 46. This downward force results when the lever arms 49 and 50 are moved from the position shown in FIG. 2 to the position shown in FIG. 10. The downward force results from cam-shaped surfaces 49*b* and 50*b* on lever arms 49 and 50 which force plate 46 downwardly in the position shown in FIG. 10. Lever arms 49 and 50 have a locking arm 51 and 52 connected thereto which serves to contact pins 53 and 54 in pressure plate 46 to lock the pressure plate upwardly into the position shown in FIG. 2. Thus pressure plate 46 is prevented from falling downward when paper is removed therefrom.

Pressure plate support bar 48 is a solid member which extends outwardly at each end to dowels 40 and 41 which are sliding received therein. At each end of pressure plate support bar 48 is a clamping mechanism generally indicated by the numeral 60. The clamping mechanism comprises a generally cubical guide 61 which has a top plate 62 having a hole therein for receipt of dowel 40 or 41.

Pivotally connected to the bottom of cubical guide 62 are clamps 70 and 71 which are hinged by flexible hinges 70*a* and 71*a* which are connected to pressure plate support bar 48. Springs 75 and 76 bias the end of clamps 70 and 71 downwardly. Clamps 70 and 71 are generally square in shape and have a hole therein for sliding receipt of dowels 40 and 41.

To slide the pressure plate 46 downwardly, the springs 75 are depressed by pushing clamps 70 and 71 upwardly, thus allowing the mechanism to be moved upwardly and downwardly on dowels 40 and 41. When the clamps are released, the springs and hinges assume the position shown in FIG. 2 and the hinges contact the side of dowels 40 and 41 to prevent upward or downward motion of assembly 45.

Figure 9:
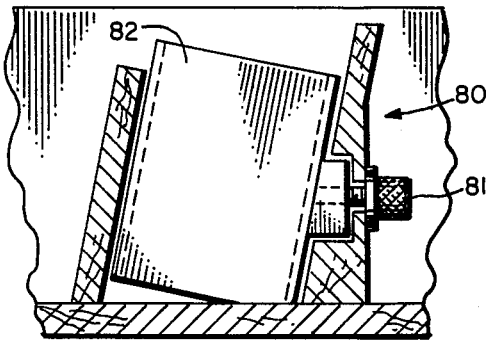
FIG. 9 is a partly cut-away, detailed view of the paper guide supporter of the invention.
Figure 5:
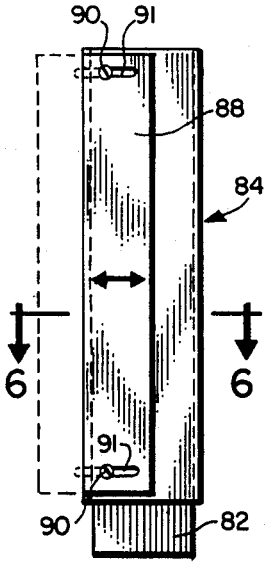
FIG. 5 is a detailed view of a paper guide mechanism of the invention.
Figure 6:
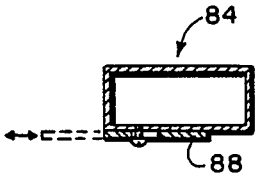
FIG. 6 is a cross sectional view taken along lines 6—6 of FIG. 5.

Located in drawer 24 are brackets generally indicated by the numeral 80 as shown in FIG. 9 for holding and supporting the paper stops generally indicated in FIG. 5 by the numeral 90. The brackets have a set screw 81 thereon which will press against a rod 82. The rods 82 are generally rectangular in cross sections and can be inserted in the brackets 80. Slidably attached to rods 82 are paper stops generally indicated by the numeral 84 as can be seen in detail in FIGS. 5 and 6. Paper stops 84 have a structural body 86 which is generally rectangular in cross section. An adjustable guide plate 88 is connected thereto by bolts 90. Bolts 90 are slidably received in slots 91 in guide plate 88. Thus, guide plate 88 may be moved as shown in FIGS. 5 and 6 to clear pressure plate 46 when pressure plate 46 is lowered.

Pressure plate 46 and the top 36 of paper supporter 30 may be made from any suitable material such as aluminum, steel, plastic or the like. Preferably, the surfaces of pressure plate 46 and top 36 which contact paper 36 are coated with a releasing agent or suitable material from which padding glue can be easily removed or stripped, such as teflon R, epoxy, or the like.

To operate the padding press of the invention, the press is assembled and the paper stops are placed in position in drawer 24. The paper 38 is placed on paper supporter 30 and the paper is aligned against paper guides 88. Next, the paper guides 88 are moved flush with paper stops 84. Pressure plate assembly 45 is then moved downwardly onto the stack of paper 38 by depressing clamps 70 and 71, lowering assembly 45 onto the stack of paper 38, and then releasing the clamps 70 and 71. Levers 49 and 50 are then rotated as indicated by the arrows in FIG. 10 to apply additional pressure to stack 38. Paper stops 84 may be removed and glue applied as shown in FIG. 11.

Although the preferred embodiment of the present invention has been disclosed and described in detail above, it should be understood that the invention is in no sense limited thereby, and its scope is to be determined by that of the following claims.

What is claimed is:

1. A modular, compact padding press capable of being quickly assembled and disassembled comprising:

a. a base means having slidable drawer means therein, said slidable drawer means having trough means therein for receiving and containing glue or adhesive which may drip from said stack of paper or other sheet material, b. a paper support means tiltably connected to said base means, said paper support means having dowel means connectable thereto; and c. pressure plate assembly means rigidly connectable to said dowel means for firmly pressing paper or other sheet material against said paper support means, said pressure plate assembly having locking means for locking said pressure plate assembly on said dowel means after said pressure plate assembly is lowered onto the top of a stack of paper or other sheet material resting on said paper support means, said pressure plate assembly means having lever arm means pivotally connected thereto for exerting additional pressure upon said paper to other sheet material resting on said paper support means.

2. The padding press of claim 1 wherein bracket means are connected to said base means.

3. The padding press of claim 2 wherein paper stop means are connected to said bracket means, said paper stop means being alignable with the edge of said paper or sheet material to which glue or adhesive is to be applied.

4. The padding press of claim 3 wherein said paper stop means have adjustable guide means connected thereto for aligning the edge of said stack of paper or other sheet material to which glue or adhesive is to be applied.

5. The padding press of claim 4 wherein said bracket means are connected to and containable in slidable drawer means, said slidable drawer means being containable and receivable in said base means.

6. The padding press of claim 1 wherein said pressure plate assembly means comprises a pressure plate support bar means having said lever arm means pivotally connected thereto and a pressure plate means having a series of aligning pin means rigidly connected thereto for aligning said pressure plate means with said pressure plate support bar and allowing relative movement therebetween, said pressure plate support bar means having hole means therein for slidably receiving said aligning pins, said lever arms means being pivotally positioned on said pressure plate support bar to contact and apply a downward force on said pressure plate means when said lever means are pivotted to an appropriate position.

7. A modular, compact padding press capable of being quickly assembled and disassembled comprising:

a. a base means;

b. a paper support means tiltably connected to said base means, said paper support means having dowel means connectable thereto; and c. pressure plate assembly means rigidly connectable to said dowel means for firmly pressing paper or other sheet material against said paper support means, said pressure plate assembly having locking means for locking said pressure plate assembly on said dowel means after said pressure plate assembly is lowered onto the top of a stack of paper or other sheet material resting on said paper support means, said pressure plate assembly means having lever arm means pivotally connected thereto for exerting additional pressure upon said paper or other sheet material resting on said paper support means, said pressure plate assembly means including a pressure plate support bar means having said lever arm means pivotally connected thereto and a pressure plate means having a series of aligning pin means rigidly connected thereto for aligning said pressure plate means with said pressure plate support bar and allowing relative movement therebetween, said pressure plate support bar means having hole means therein for slidably receiving said aligning pins, said lever arms means being pivotally positioned on said pressure plate support bar to contact and apply a downward force on said pressure plate means when said lever means are pivotted to an appropriate position.

8. The padding press of claim 7 wherein said locking means are connected to said pressure plate support bar and comprise guide means having a hole means therein through which said dowel means are slidably received and clamp means connected to said guide means for selectively contracting said dowel means to secure said pressure plate support means to said dowel means.

9. The padding press of claim 8 wherein said clamp means are flat plate means having hole means therein for receipt of said dowel means which are hingedly connected at one edge to said guide means and biased away from said guide means by spring means connected to said guide means and said plate means.

10. The padding press of claim 9 wherein said dowel means comprise at least two dowels extending upwardly from said paper support means.

* * * * *